United States Patent [19]

Bleckmann et al.

[11] 4,323,532

[45] Apr. 6, 1982

[54] METHOD FOR COMPRESSING AND AGGLOMERATING COAL DUST

[75] Inventors: Hugo Bleckmann, Bonn; Kellerwessel, Aachen, both of Fed. Rep. of Germany

[73] Assignee: Klöckner-Humboldt-Deutz AG, Fed. Rep. of Germany

[21] Appl. No.: 207,698

[22] Filed: Nov. 17, 1980

[30] Foreign Application Priority Data

Nov. 24, 1979 [DE] Fed. Rep. of Germany ..... 2947386

[51] Int. Cl.[3] ..... B01J 2/22

[52] U.S. Cl. ..... 264/118; 264/117; 23/314

[58] Field of Search ..... 264/109, 117, 118; 23/314

[56] References Cited

U.S. PATENT DOCUMENTS

| | | | |
|---|---|---|---|
| 3,665,066 | 5/1972 | Capes et al. | 264/117 |
| 3,980,745 | 9/1976 | Hendrickson et al. | 264/109 |
| 3,986,864 | 10/1976 | Hofmann | 264/118 |
| 4,036,928 | 7/1977 | Valenta | 264/118 |

*Primary Examiner*—James R. Hall

*Attorney, Agent, or Firm*—Hill, Van Santen, Steadman, Chiara & Simpson

[57] ABSTRACT

The present invention is directed to a method for compressing and agglomerating coal dust without the use of bonding agents in which the coal dust is passed through a conventional roll press operating at a compressive force of at least 20 kilonewtons (kN) per centimeter (cm) of roll width. The high pressure conditions make it possible to secure suitable compression and agglomeration at temperatures below 200° C.

4 Claims, No Drawings

METHOD FOR COMPRESSING AND AGGLOMERATING COAL DUST

BACKGROUND OF THE INVENTION

1. Field of the Invention.

This invention is in the field of compressing and agglomerating coal dust to produce a compact of the coal dust particles without the use of a separate binder and involves passing the dust through a roll press operating at a compressive force of at least 20 kN per cm of roll width and at circumferential roll velocities ranging from about 0.1 to 1.0 m/sec.

2. Description of the Prior Art

A method for compressing fine grained coal has been described in German AS 2,046,977. In the disclosure in that reference, a coal which contains coking ingredients is heated before being passed through a roll press to a temperature just below the temperature at which softening of the coking type coal begins. The coal is heated beyond its point of softening in the roll press due to the pressure of the press. As a result, a plastic deformation occurs resulting in the discharge of bituminous materials which function as a bonding agent. By means of this technique, fine grained coil can be pressed into compacts which exhibit a high degree of stability without the use of special bonding agents.

SUMMARY OF THE INVENTION

The present invention provides a method which renders possible a compression and agglomeration of fine grained coal from any origin and composition without the use of bonding agents, and at temperatures which are substantially below the softening point of the bituminous materials in the coal. Surprisingly, it has been found that fine grained coal, particularly coal dust, can be compressed in a conventional roll press into solid, compact agglomerates both at room temperature as well as at temperatures which still lie far below the softening point of the coal when forces of more than 20 kN/cm of roll width are applied. The compact agglomerates produced in this maner have an apparent density between 1.0 g/cm$^3$ and 1.5 g/cm$^3$, and exhibit a high stability so that they can be transported over great distances and stored outdoors for a number of months without significant changes of shape or formation of dust occurring. One of the advantages of the present method consists that even fine grained coal can be compressed or agglomerated in an ordinary roll press assembly into solid and durable compacts at room temperature or temperatures which lie far below the softening point of the coal without bonding agent additives or bituminous materials being present. The temperatures in accordance with the present invention may range from about 20° to 150° C. and are consistently below 200° C. This temperature range is still far enough below the softening point of the coking coal (300° through 350° C.) that a noticeable deterioration of coking properties need not be feared at these temperatures.

In a further preferred form of the present invention, the circumferential velocity of the roll amounts to about 0.1 to 1 m/sec. In the case of relatively dry material (having a moisture content below 2 weight percent), the circumferential velocity ranges from about 0.2 m/sec to 0.4 m/sec. In the use of damp coal, it is expedient to conduct the compression and agglomeration of the coal with a circumferential roll velocity between 0.4 m/sec and 1 m/sec in order to produce agglomerates of particularly high stability and storage life.

The method of the present invention does not require any significant variation in the operation of conventional roll presses in which raw material is compacted as it is carried into the gap between two rolls rotating at equal speeds. In general, the method of the present invention can make use of smooth rolls which produce a solid sheet which can be granulated into a desired particle size on conventional grinding equipment.

DESCRIPTION OF THE PREFERRED EMBODIMENTS

The invention provides a method for compressing and agglomerating coal dust without the use of bonding agents by passing the dust through a roll press operating at a compressive force of at least 20 kN per cm of roll width to compact and agglomerate the dust. The compression takes place at a temperature below 200° C. and preferably may occur from temperatures of 20° to 150° C. Where relatively dry coal dust is employed, the rolls may have a circumferential velocity of from 0.1 to 0.4 m/sec and preferably from 0.2 to 0.4 m/sec. In the case of relatively damp coal (at least 2 weight percent water), the coal is compressed at a circumferential roll velocity of from 0.4 to 1.0 m/sec.

A further description of the present invention will be made in conjunction with the attached specific examples.

EXAMPLE 1

This test procedure involved pressure agglomeration at room temperature. Coal dust from a northern European coal dressing plant having the following properties and grain size distribution was fed for compression and agglomeration into a standard roll press having a roll diameter of 800 mm and a roll width of 120 mm:

| | |
|---|---|
| Water content | 5.4 weight % |
| Tap density | 0.69 kg/dm$^3$ |
| Powder density | 0.47 kg/dm$^3$ |
| Density | 1.26 g/cm$^3$ |
| Volatile component content | 40.2 weight % |
| Ash content | 7.05 weight % |

Grain Size Distribution

| Size of grain in mm | Weight % |
|---|---|
| >1 | 0.8 |
| 1–0.71 | 0.4 |
| 0.71–05 | 0.7 |
| 0.5–0.315 | 5.0 |
| 0.315–0.25 | 4.0 |
| 0.25–0.18 | 9.6 |
| 0.18–0.125 | 21.3 |
| 0.125–0.09 | 16.9 |
| 0.09–0.063 | 17.3 |
| <0.063 | 24.0 |

The compression and agglomeration of this coal dust occurred using a pre-stress of the pressure rolls of 50 kN per cm of roller width, and a compression force of 55 through 57.5 kN per cm of roller width. The circumferential velocity of the drum was 0.29 m/sec. The compact agglomerates produced in this manner had an apparent density of from 1.02 to 1.04 g/cm$^3$, and exhibited high stability and storability.

EXAMPLE 2

This procedure involved pressure agglomeration of preheated coal. In the test, which was carried out with the same conventional roll press as described in the first example, was given the same compression force and a circumferential velocity of 0.17 m/sec. The fine grained coal was preheated to approximately 140° C. before compression and agglomeration. This coal consisted of a mixture of coal dust having the analysis previously given and a fine grained open burning coal from the Ruhr region having the following qualities and grain size distribution:

| | |
|---|---|
| Water content | 0 weight % |
| Powder density | 0.73 kg/dm$^3$ |
| Tap density | 0.80 kg/dm$^3$ |
| Volatile component content | 33.2 weight % |
| Ash content | 6.5 weight % |

Grain Size Distribution

| Size of grain in mm | Weight % |
|---|---|
| >2 | 2.1 |
| 2–1 | 11.3 |
| 1–0.71 | 23.3 |
| 0.71–0.5 | 15.7 |
| 0.5–0.315 | 15.9 |
| 0.315–0.25 | 7.4 |
| 0.25–0.18 | 8.2 |
| 0.18–0.125 | 3.8 |
| 0.125–0.09 | 3.1 |
| 0.09–0.063 | 3.1 |
| <0.063 | 6.1 |

As the foregoing test demonstrated, agglomerates which are highly resistant to transport and storage could be produced in an ordinary roll press by means of preheating the coal employed to a temperature below 200° C. In the test, there was no noticeable reduction of the coking properties in the coal, since not even 2 weight % of the volatile components were lost or escape at these temperatures.

Further tests with fine grained damp coal having approximately 2 weight % moisture content demonstrated that highly compressed, compacted agglomerates of high stability could be achieved given an increase in the circumferential velocity of the roll to 0.8 m/sec and a reduction in the compression force to 32 kN per cm of roll width.

Fine grained coal which had not been compressed by the rolls in these tests in the area of the roll edges was again added to the feed material. It was found that neither the compaction yield nor the compression ratio was unfavorably influenced by the return of this fine grained material.

It should be evident that various modifications can be made to the described embodiments without departing from the scope of the present invention.

We claim as our invention:

1. A method for forming granulates from finely divided coal particles which comprises:

feeding said particles at a temperature below the coal softening point into a roll press operating at a compressive force of at least 20 kN per cm of roll width and a circumferential velocity of up to 1.0 m/sec to form a solid sheet without the addition of extraneous binders, and grinding the resulting sheet into granulates.

2. A method according to claim 1 in which:

said particles are at a temperature of from 20° to 150° C.

3. A method according to claim 1 in which:

said particles have a moisture content below 2% by weight, and said roll press is operated at a circumferential velocity of from 0.1 to 0.4 m/sec.

4. A method according to claim 1 in which:

said particles have a moisture content of at least 2% by weight and said roll press is operated at a circumferential velocity of from 0.4 to 1 m/sec.

* * * * *